US011407617B2

(12) United States Patent
Bhaskar

(10) Patent No.: US 11,407,617 B2
(45) Date of Patent: Aug. 9, 2022

(54) SIMPLY-SUPPORTED RECIRCULATING ELEVATOR SYSTEM

(71) Applicant: Otis Elevator Company, Farmington, CT (US)

(72) Inventor: Kiron Bhaskar, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 652 days.

(21) Appl. No.: 16/125,861

(22) Filed: Sep. 10, 2018

(65) Prior Publication Data

US 2019/0077637 A1 Mar. 14, 2019

Related U.S. Application Data

(60) Provisional application No. 62/555,773, filed on Sep. 8, 2017.

(51) Int. Cl.

| | |
|---|---|
| ***B66B 11/00*** | (2006.01) |
| ***B66B 7/02*** | (2006.01) |
| ***B66B 7/04*** | (2006.01) |
| ***B66B 9/00*** | (2006.01) |
| ***B66B 11/04*** | (2006.01) |
| ***B66B 9/02*** | (2006.01) |

(52) U.S. Cl.

CPC ..... *B66B 11/005* (2013.01); *B66B 7/022* (2013.01); *B66B 7/046* (2013.01); *B66B 9/003* (2013.01); *B66B 9/02* (2013.01); *B66B 11/0438* (2013.01)

(58) Field of Classification Search

CPC ..... B66B 11/005; B66B 7/022; B66B 7/046; B66B 9/003; B66B 9/02; B66B 11/0438

See application file for complete search history.

(56) References Cited

U.S. PATENT DOCUMENTS

| | | | | |
|---|---|---|---|---|
| 3,664,523 | A * | 5/1972 | Hagel | E04H 6/285 414/255 |
| 4,004,654 | A * | 1/1977 | Hamy | B66B 9/003 198/798 |
| 5,464,072 | A | 11/1995 | Mueller | |
| 5,558,181 | A | 9/1996 | Bundo | |
| 5,566,784 | A | 10/1996 | Rennetaud | |
| 5,713,432 | A | 2/1998 | Richter et al. | |
| 5,769,183 | A | 6/1998 | Richter et al. | |

(Continued)

FOREIGN PATENT DOCUMENTS

| | | | |
|---|---|---|---|
| CN | 1143045 | A | 2/1997 |
| CN | 2339558 | Y | 9/1999 |

(Continued)

OTHER PUBLICATIONS

JP03177290—Machine Translation (Year: 1991).*

(Continued)

*Primary Examiner* — Michael A Riegelman

(74) *Attorney, Agent, or Firm* — Cantor Colburn LLP

(57) ABSTRACT

An elevator system includes a hoistway, a rail extending along the hoistway and an elevator car located in and movable along the hoistway. A drive assembly is operably connected to the elevator car and includes two or more wheels engaged to opposing surfaces of the rail. The drive assembly is configured to apply an engagement force to the rail to both support the elevator car at the rail and drive the elevator car along the rail.

16 Claims, 11 Drawing Sheets

(56) References Cited

U.S. PATENT DOCUMENTS

| | | | |
|---|---|---|---|
| 5,944,144 | A | 8/1999 | Hein |
| 8,863,907 | B2 | 10/2014 | Studer et al. |
| 10,486,941 | B2 * | 11/2019 | Finschi ..... B66B 9/022 |
| 2006/0163008 | A1 | 7/2006 | Godwin |
| 2007/0084672 | A1 | 4/2007 | Helmle et al. |
| 2016/0297646 | A1 | 10/2016 | Piech et al. |
| 2017/0057784 | A1 | 3/2017 | Witczak et al. |
| 2017/0088396 | A1 | 3/2017 | Fargo |
| 2017/0158461 | A1 | 6/2017 | Roberts et al. |

FOREIGN PATENT DOCUMENTS

| | | | |
|---|---|---|---|
| CN | 1250744 | A | 4/2000 |
| CN | 200988717 | Y | 12/2007 |
| CN | 105366493 | A | 3/2016 |
| CN | 205312834 | U | 6/2016 |
| CN | 106477406 | A | 3/2017 |
| DE | 3939762 | A1 | 6/1991 |
| JP | 03177290 | A | 8/1991 |
| WO | 2005115906 | A2 | 12/2005 |
| WO | 2008136692 | A2 | 11/2008 |
| WO | 2012038760 | A2 | 3/2012 |
| WO | 2016050803 | A1 | 4/2016 |
| WO | 2016203104 | A1 | 12/2016 |
| WO | 2017027503 | A1 | 2/2017 |

OTHER PUBLICATIONS

Showrig, Pinch Wheel Motor Grid Rail System, Las Vegas, NV, Los Angeles, CA, Sep. 6, 2018, 1 Page, www.sgsp.net Previously Uploaded on Sep. 10, 2018.

Ziehl-Abegg, ZAwheel in-wheel hub motor, Greensboro, NG, Sep. 6, 2018, 1 Page. Previously Uploaded on Sep. 10, 2018.

Chinese Office Action Issued in CN Application No. 201811043478.7, dated Nov. 29, 2019, 23 Pages.

European Search Report Issued in EP Application No. 18190821.1, dated Feb. 13, 2019, 9 Pages.

European Search Report Issued in EP Application No. 18193555.2, dated Mar. 7, 2019, 8 Pages.

* cited by examiner

SIMPLY-SUPPORTED RECIRCULATING ELEVATOR SYSTEM

CROSS-REFERENCE TO RELATED APPLICATIONS

This application claims the benefit of 62/555,773, filed Sep. 8, 2017, which is incorporated herein by reference in its entirety.

BACKGROUND

Exemplary embodiments pertain to the art of elevator systems.

Typical elevator systems utilize an elevator car suspended in a hoistway via one or more load bearing members, such as ropes or belts. The load bearing members are driven via a traction arrangement with a drive machine and drive sheave fixed in the hoistway, thus moving the elevator car along the hoistway.

Such arrangements limit the number of cars that may operate in the same hoistway. Further, the typical system requires many additional components separate from the elevator car. Further, as lifting height increases, the weight of the required load bearing member increases as well, typically resulting in an increased sizing of the drive machine to lift not only the elevator car, but also the associated load bearing member.

BRIEF DESCRIPTION

In one embodiment, an elevator system includes a hoistway, a rail extending along the hoistway and an elevator car located in and movable along the hoistway. A drive assembly is operably connected to the elevator car and includes two or more wheels engaged to opposing surfaces of the rail. The drive assembly is configured to apply an engagement force to the rail to both support the elevator car at the rail and drive the elevator car along the rail.

Additionally or alternatively, in this or other embodiments, a prime mover is operably connected to a wheel of the two or more wheels to drive rotation of the wheel about a wheel axis.

Additionally or alternatively, in this or other embodiments, the prime mover is a hub wheel motor positioned at the wheel.

Additionally or alternatively, in this or other embodiments, the two or more wheels engage the rail via an engagement force applied by one or more of a spring element, or a mechanical, electrical or hydraulic actuator.

Additionally or alternatively, in this or other embodiments, the rail includes a rail web connected to rail flanges, the wheels positioned on opposing sides of the rail web.

Additionally or alternatively, in this or other embodiments, applying the engagement force urges the wheels toward the rail web.

Additionally or alternatively, in this or other embodiments, a bearing assembly supports the drive assembly at the elevator car.

Additionally or alternatively, in this or other embodiments, the drive assembly is located at a top of the elevator car.

Additionally or alternatively, in this or other embodiments, the elevator system includes two hoistways. The elevator car is configured to transfer from a first hoistway of the two hoistways to a second hoistway of the two hoistways.

Additionally or alternatively, in this or other embodiments, the elevator system includes a first guide rail portion extending along the first hoistway, a second guide rail portion extending along the second hoistway, and a transition portion connecting the first guide rail portion and the second guide rail portion. The elevator car and the drive assembly are configured to allow for travel of the elevator car in a vertical position along the first guide rail portion, the second guide rail portion and the transition portion without disengagement of the elevator car from the guide rail.

Additionally or alternatively, in this or other embodiments, a bearing assembly supports the drive assembly at the elevator car. The bearing assembly is configured to allow for rotation of the elevator car relative to the drive assembly when the elevator car is urged along the transition portion to maintain the elevator car in a vertical orientation.

Additionally or alternatively, in this or other embodiments, the elevator system includes a transfer rail and a transfer carriage receptive of the elevator car and movable along the transfer rail to transfer the elevator car from the first hoistway to the second hoistway. The transfer carriage includes a direct drive prime mover to move the transfer carriage along the transfer rail.

Additionally or alternatively, in this or other embodiments, the direct drive prime mover is a wheel hub motor.

In another embodiment, an elevator system includes a first hoistway, a second hoistway, a guide rail including a first guide rail portion extending along the first hoistway, a second guide rail portion extending along the second hoistway and a transition portion connecting the first guide rail portion and the second guide rail portion. An elevator car is located in and movable along the guide rail. A drive assembly is operably connected to the elevator car and includes two or more wheels engaged to opposing surfaces of the rail. The drive assembly is configured to apply an engagement force to the rail to both support the elevator car at the rail and drive the elevator car along the rail. The elevator car and the drive assembly are configured to allow for travel of the elevator car in a vertical position along the first guide rail portion, and to transfer from the first hoistway to the second hoistway via the transition portion.

Additionally or alternatively, in this or other embodiments, the elevator car and the drive assembly are configured to allow for travel of the elevator car in a vertical position along the first guide rail portion, the second guide rail portion and the transition portion without disengagement of the elevator car from the guide rail.

Additionally or alternatively, in this or other embodiments, a bearing assembly supports the drive assembly at the elevator car. The bearing assembly is configured to allow for rotation of the elevator car relative to the drive assembly when the elevator car is urged along the transition portion to maintain the elevator car in a vertical orientation.

Additionally or alternatively, in this or other embodiments, the elevator system includes a transfer rail located at the transition portion and a transfer carriage receptive of the elevator car and movable along the transfer rail to transfer the elevator car from the first hoistway to the second hoistway. The transfer carriage includes a direct drive prime mover to move the transfer carriage along the transfer rail.

Additionally or alternatively, in this or other embodiments, the direct drive prime mover is a wheel hub motor.

Additionally or alternatively, in this or other embodiments, the two or more wheels engage the rail via an engagement force applied by one or more of a spring element, or a mechanical, electrical or hydraulic actuator.

Additionally or alternatively, in this or other embodiments, the rail includes a rail web connected to rail flanges, the wheels located on opposing sides of the rail web.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
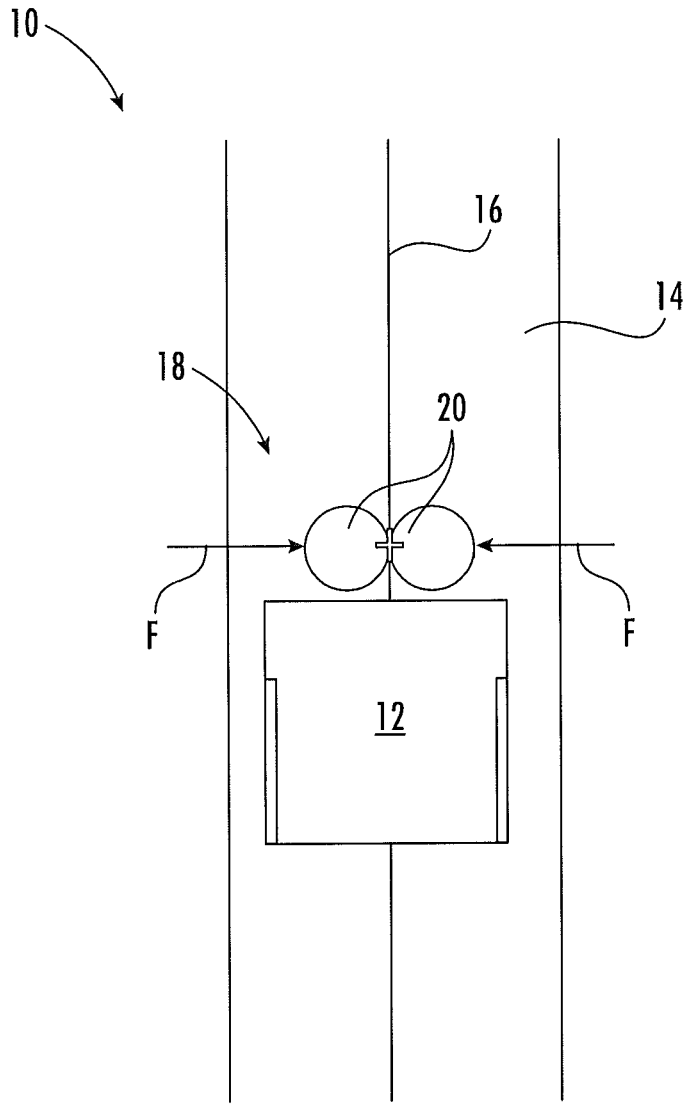
FIG. 1 is a schematic view of an embodiment of an elevator system.

Referring to FIG. 1, an elevator system 10 includes an elevator car 12 located within a hoistway 14. One or more rails 16 are affixed to a wall of the hoistway 14. The elevator car 12 is operably connected to each of the rails 16 by a drive assembly 18, utilizing two or more wheels 20 that apply an engagement force F to the rail 16 to hold engage the elevator car 12 with the rail 16. The wheels 20 are rotatably driven about their central axes to urge the elevator car 12 along the rail 16. In the embodiment illustrated, two wheels 20 are utilized to engage the rail 16 and drive movement of the elevator car 12, but in other embodiments, three or more wheels 20 may be utilized. Further, while in the embodiment shown, the drive assembly 18 is located at a top of the elevator car 12, one skilled in the art will appreciate that the drive assembly 18 may be located at other locations, such as a bottom of the elevator car 12 or at lateral side of the elevator car 12 between the top and the bottom.

Figure 2:
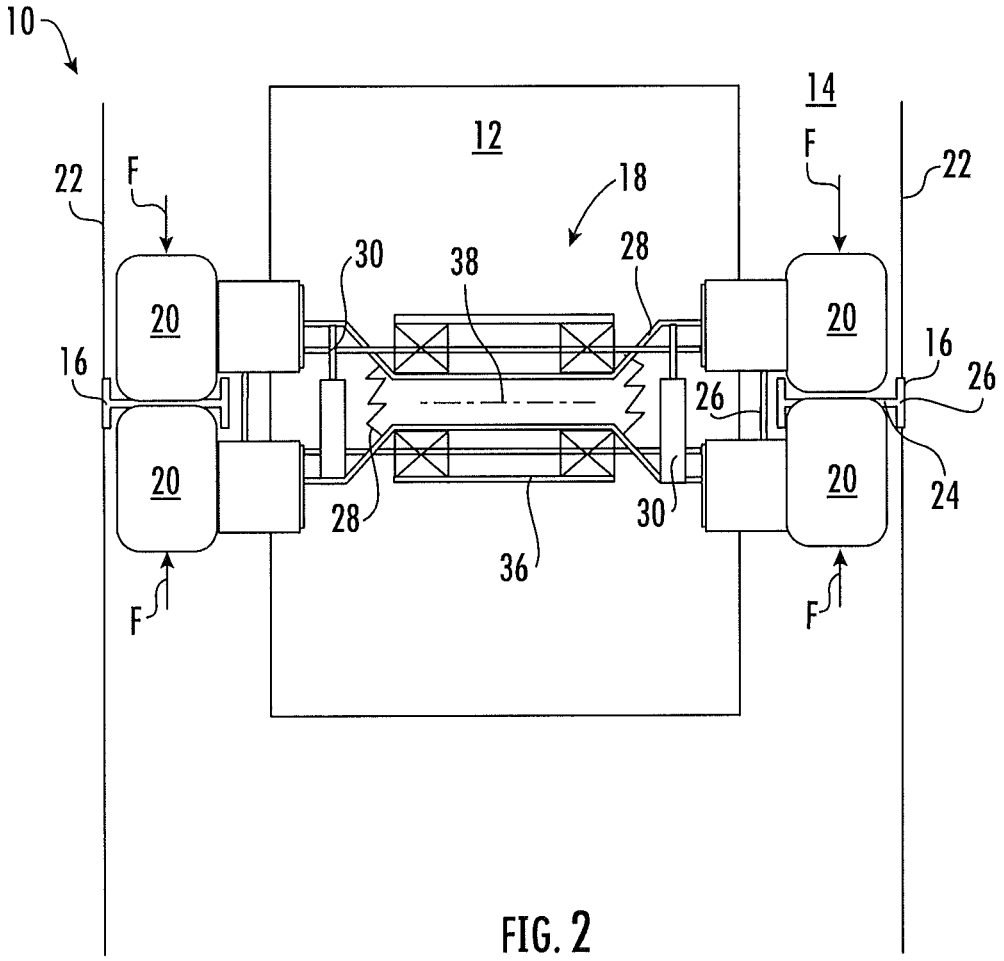
FIG. 2 is another schematic view of an embodiment of an elevator system.

Referring now to FIG. 2, a top view of a portion of the elevator system 10 is shown. The elevator system 10 includes two rails 16, with the two rails 16 located at opposing hoistway walls 22 such that the elevator car 12 is positioned between the rails 16. The rail 16 in the embodiment of FIG. 2 is I-shaped in cross-section, with a rail web 24 extending between two rail flanges 26. In other embodiments, however, other rail 16 cross-sectional shapes, such as a C-shaped rail 16 or a T-shaped rail 16 may be utilized. The rail 16 shape may be formed by, for example, extrusion or sheet-metal forming.

The drive assembly 18 includes four wheels 20, with two wheels 20 positioned at each rail 16 and urged into engagement with opposing sides of the rail web 24. The engagement force F is applied by, for example, a spring element 28 as shown in FIG. 2 to bias the wheels 20 toward the rail web 24. Further, a linear or rotary actuator 30 may be utilized as a backup to ensure engagement of the wheels 20 with the rail web 24.

Figure 3:
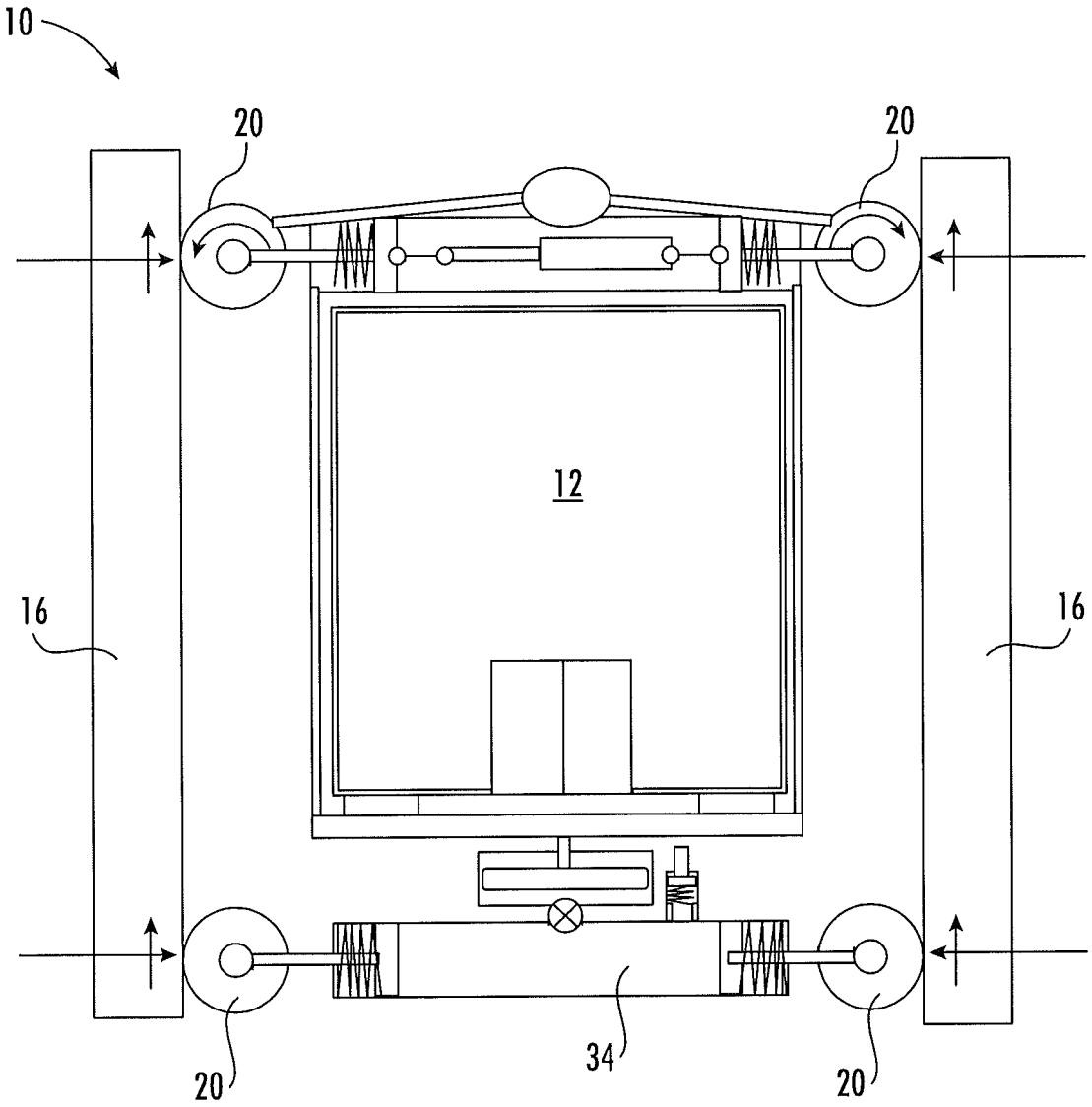
FIG. 3 is yet another schematic view of an embodiment of an elevator system.
Figure 4:
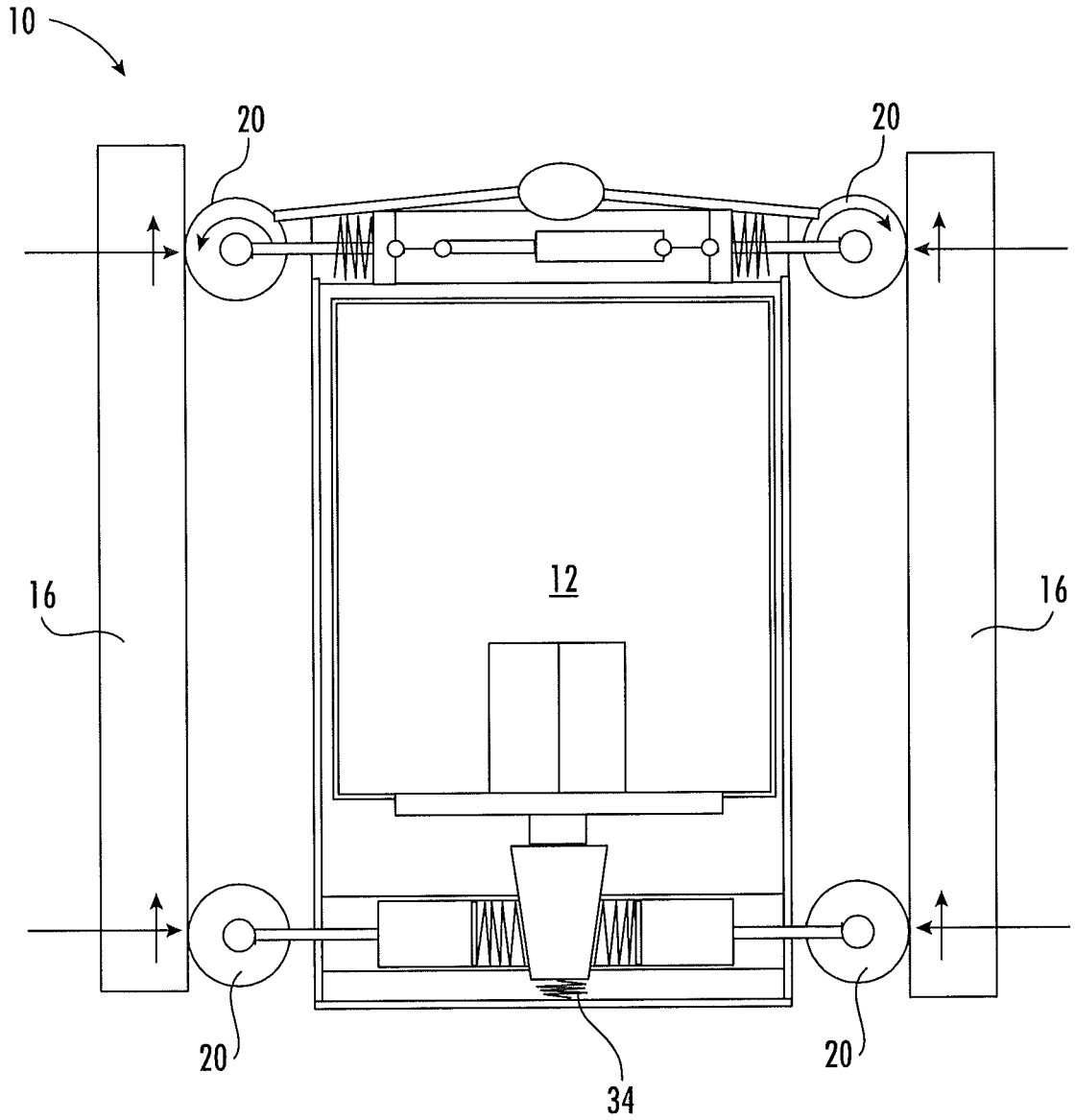
FIG. 4 is still another schematic view of an embodiment of an elevator system.

In other embodiments, such as shown in FIG. 3, a hydraulic actuator 32 may be utilized while in still another embodiment shown in FIG. 4, a wedge 34 may be utilized to urge the wheels 20 into engagement with the rail 16. It is to be appreciated that the configurations disclosed herein are merely exemplary, and other configurations may be utilized to apply the engagement force F to the wheels 20 to ensure engagement with the rail webs 24.

Referring again to FIG. 2, the drive assembly 18 is supported in a bearing assembly 36, which is fixed to the elevator car 12. The bearing assembly 36 is typically in a locked position such that rotation of the elevator car 12 relative to the rails 16 is prevented, such as during conventional up/down travel of the elevator car 12 along the hoistway 14.

Figure 5:
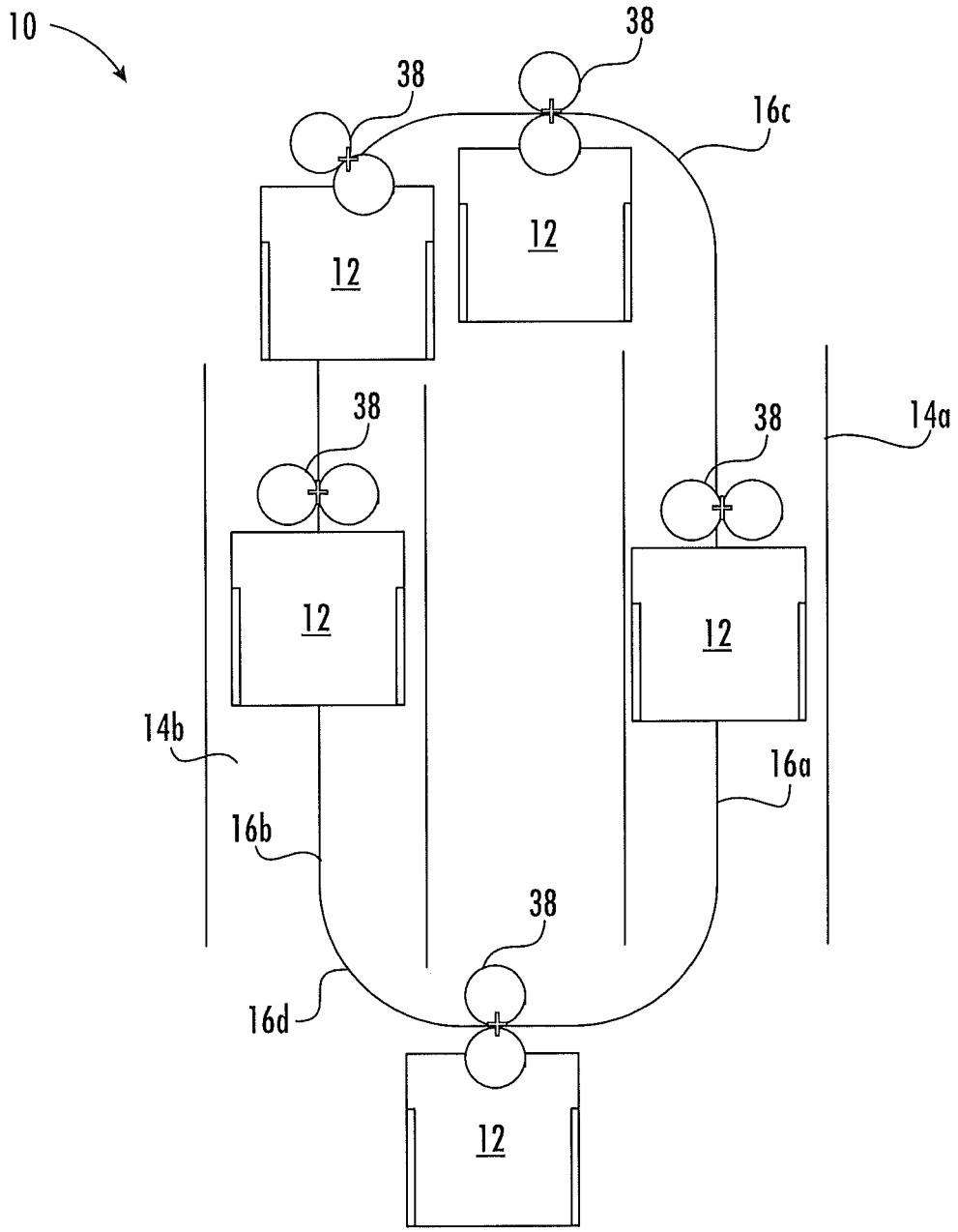
FIG. 5 is a schematic view of an embodiment of an elevator system including recirculation.

In some configurations, such as shown in FIG. 5, however, the elevator system 10 is configured as a circulation elevator system 10 with multiple elevator cars 12. In the configuration shown in FIG. 5, the rail 16 extends along a first hoistway 14*a* and along a second hoistway 14*b*, with a first rail portion 16*a* and a second rail portion 16*b*, respectively. The first rail portion 16*a* and 16*b* are connected by an upper transition portion 16*c* located at an upper portion of the elevator system 10, and a lower transition portion 16*d* similarly located at a lower portion of the elevator system 10. The transition portions 16*c* and 16*d* allow the elevator car 12 to move between the hoistways 14*a*, 14*b* without disengaging the rail 16.

When moving the elevator car 12 along the transition portions 16*c*, 16*d* it is desired to keep the elevator car in a vertical orientation for travel along the hoistways 14*a*, 14*b*. As such, when the elevator car 12 reaches the transition portions 16*c*, 16*d*, the bearing assembly 36 is switched to an unlocked position allowing relative motion between the drove assembly 18 and the elevator car 12 about a drive axis 38, as shown. The elevator car 12 remains in a vertical orientation as the elevator car 12 passes through the transition portions 16*c*, 16*d*, as further illustrated in FIG. 6.

Figure 6:
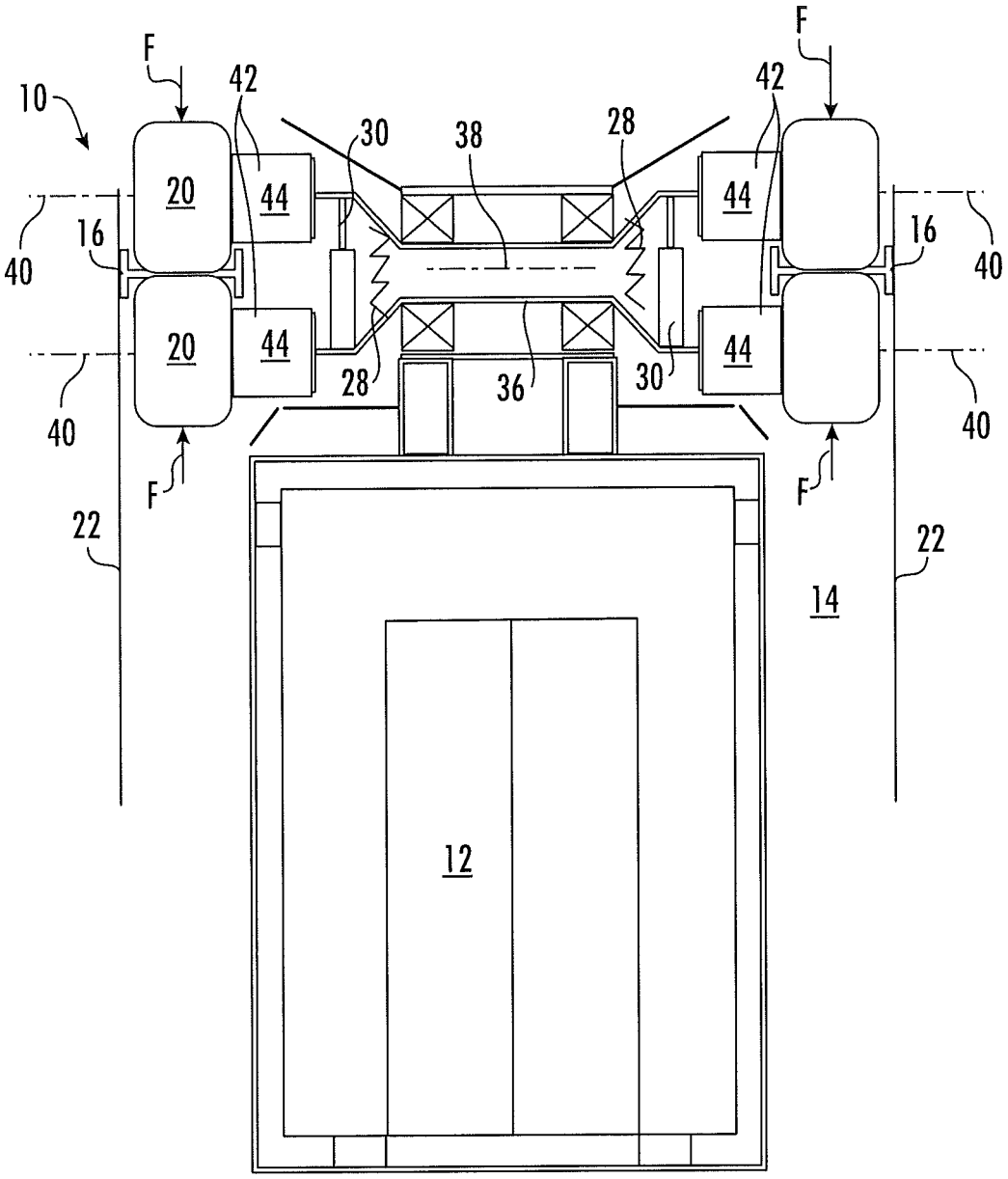
FIG. 6 is another schematic view of an embodiment of an elevator system.

Referring to FIG. 6, the wheels 20 are driven about their respective wheel axes 40 by a prime mover 42. In some embodiments, the wheels are collectively driven by a single prime mover 42, while in the embodiment of FIG. 6, each wheel 20 is individually driven by a separate prime mover 42. In some embodiments, the prime mover 42 is a direct drive prime mover 42, such as a wheel hub motor 44. In some embodiments, each wheel 20 is driven by the prime mover in a torque range of 4000 Nm to 7200 Nm, and at a rotational speed about the wheel axis 40 of less than 1000 RPM.

Figure 7:
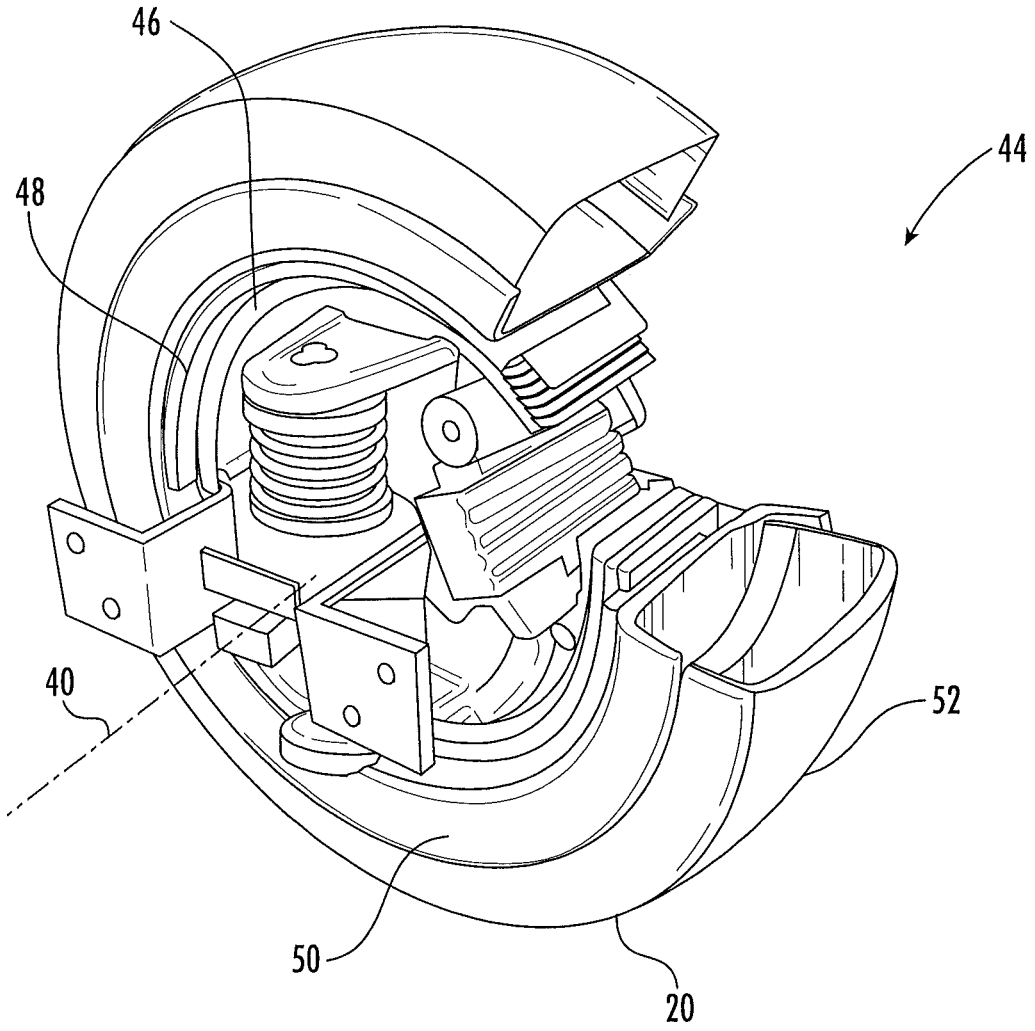
FIG. 7 is a schematic illustration of an embodiment of a prime mover for an elevator system.

Referring now to FIG. 7, the wheel hub motor 44 includes a rotationally fixed stator 46 having a plurality of windings (not shown). A rotor 48 is located about the stator 46 and may be supported by a bearing (not shown). When the stator 46 windings are energized, the electromagnetic field generated by the stator 46 causes rotation of the rotor 48 about the wheel axis 40. The rotor 48 is operably connected to the wheel 20 via, for example a wheel rim 50 or a shaft (not shown). In the embodiment of FIG. 7, the rotor 48 is connected to the wheel rim 50 via one or more mechanical fasteners, such as bolts, such that rotation of the rotor 48 about the wheel axis 40 drives rotation of the wheel rim 50 about the wheel axis 40. In other embodiments, the wheel rim 50 may be configured as the rotor 48. In some embodiments, the wheel 20 include a contact element, such as a tire 52 mounted to the wheel rim 50 and configured to rotate with the wheel rim 50. Further, the one or more additional elements, such as a brake assembly (not shown) and/or a damping device (not shown) may be installed at the wheel 20 to enhance operation of the wheel 20 and/or the wheel hub motor 44.

Figure 8:
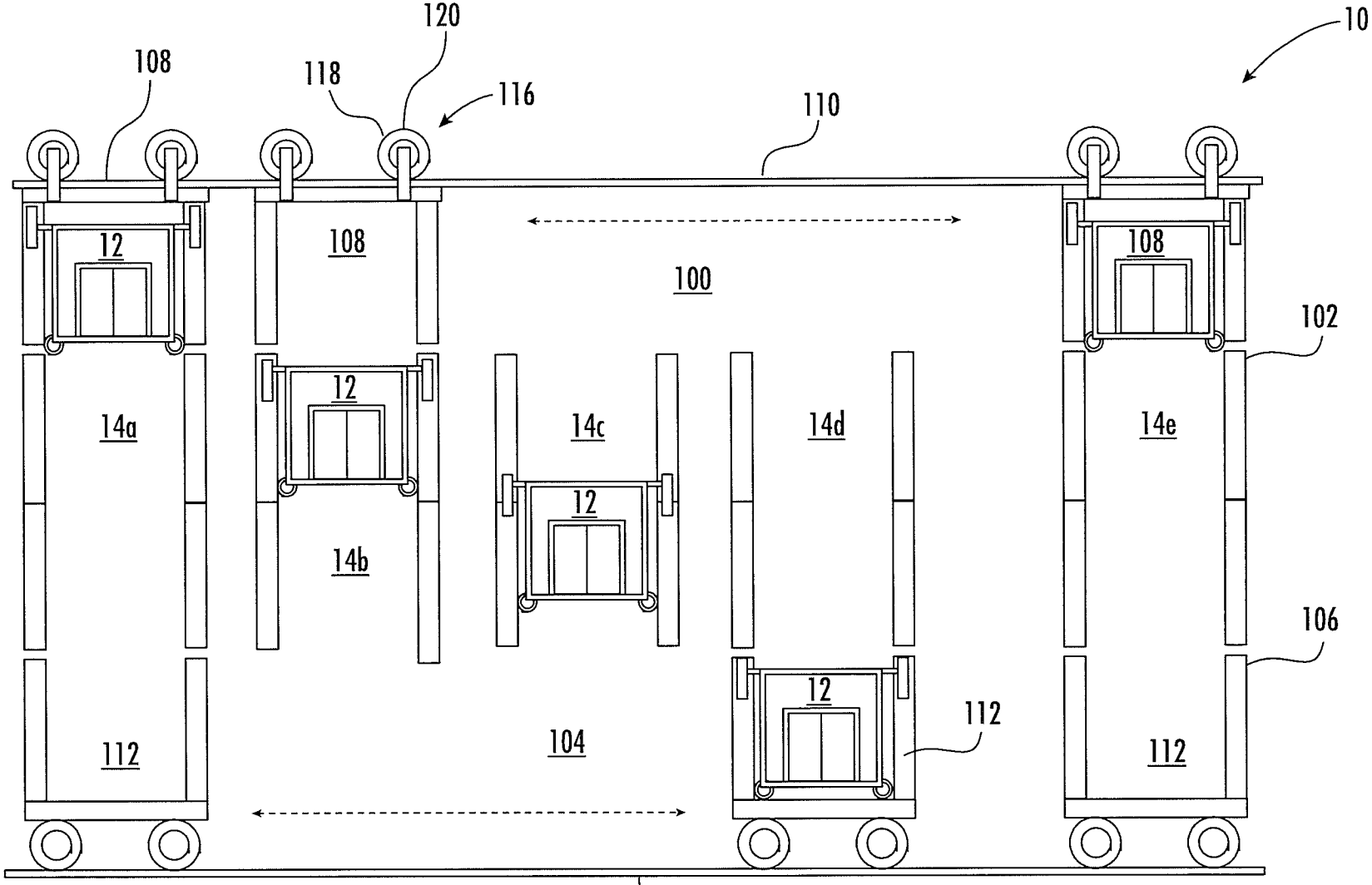
FIG. 8 is another schematic view of an embodiment of an elevator system including recirculation.

Another embodiment of the elevator system 10 configured as a circulation elevator system 10 is illustrated in FIG. 8. In the embodiment of FIG. 8 an upper transfer zone 100 extends across an upper end 102 of the hoistways 14*a*, 14*b*, 14*c*, 14*d*, 14*e*, while a lower transfer zone 104 extends across a lower end 106 of the hoistways 14*a-e*. It is to be appreciated that, alternatively or additionally, transfer zones may be located at intermediate locations along the hoistways 14*a-e*, between the upper end 102 and the lower end 104. One or more upper transfer carriages 108 are located in the upper transfer zone 100 and are moveable between hoistways 14*a-e* along an upper transfer rail 110. Similarly, one or more lower transfer carriages 112 are located in the lower transfer zone 104 and are movable between hoistways 14*a-e* along a lower transfer rail 114.

Figure 9:
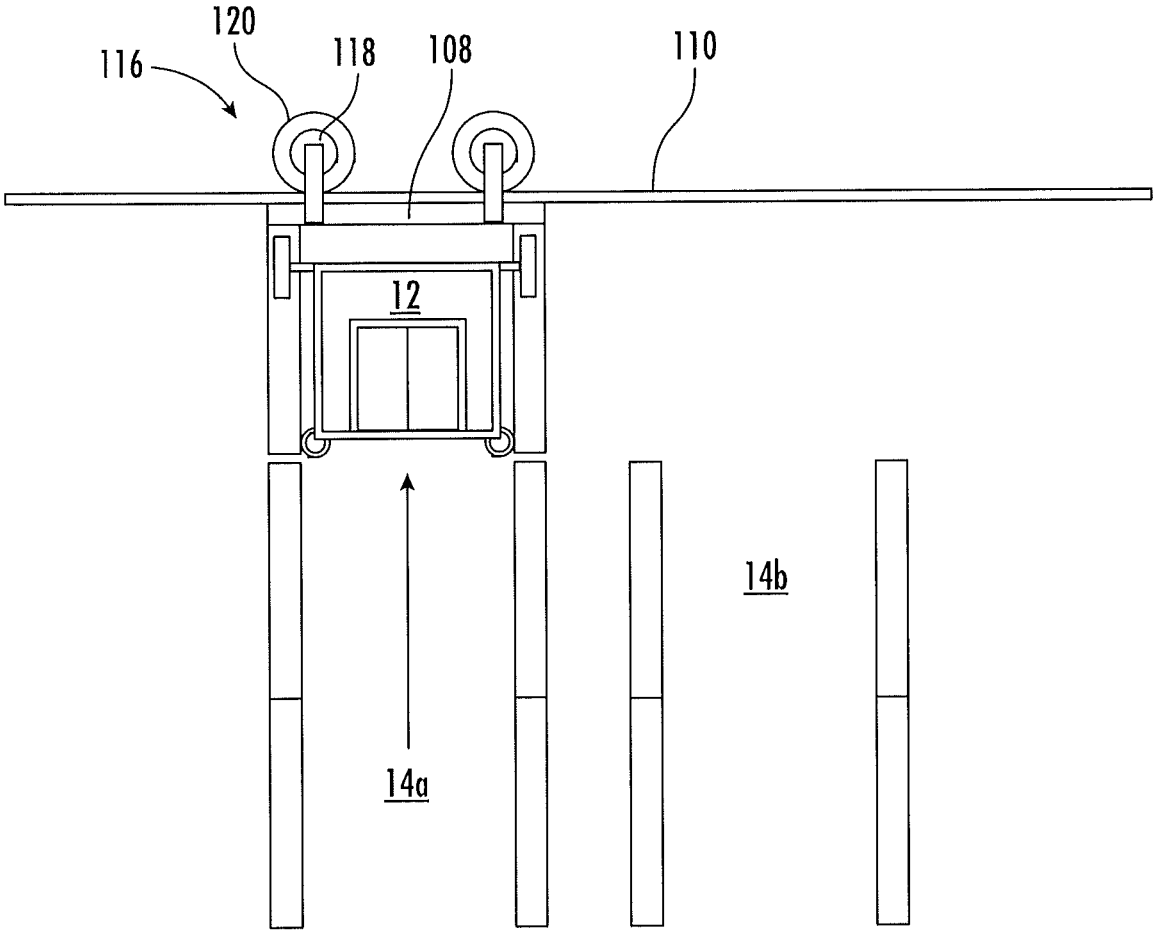
FIG. 9 is a schematic illustration of a transfer of an elevator car between two hoistways.
Figure 10:
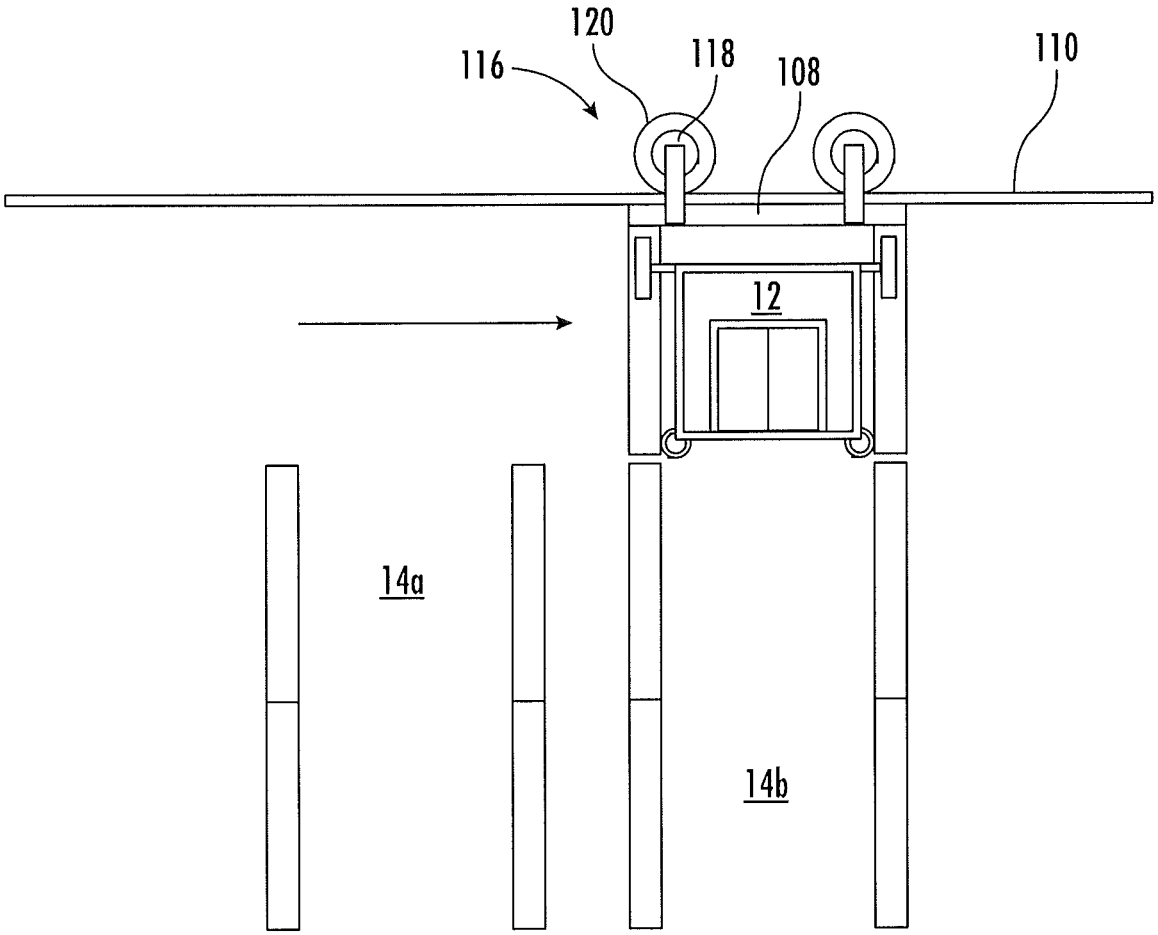
FIG. 10 is another schematic illustration of a transfer of an elevator car between two hoistways.
Figure 11:
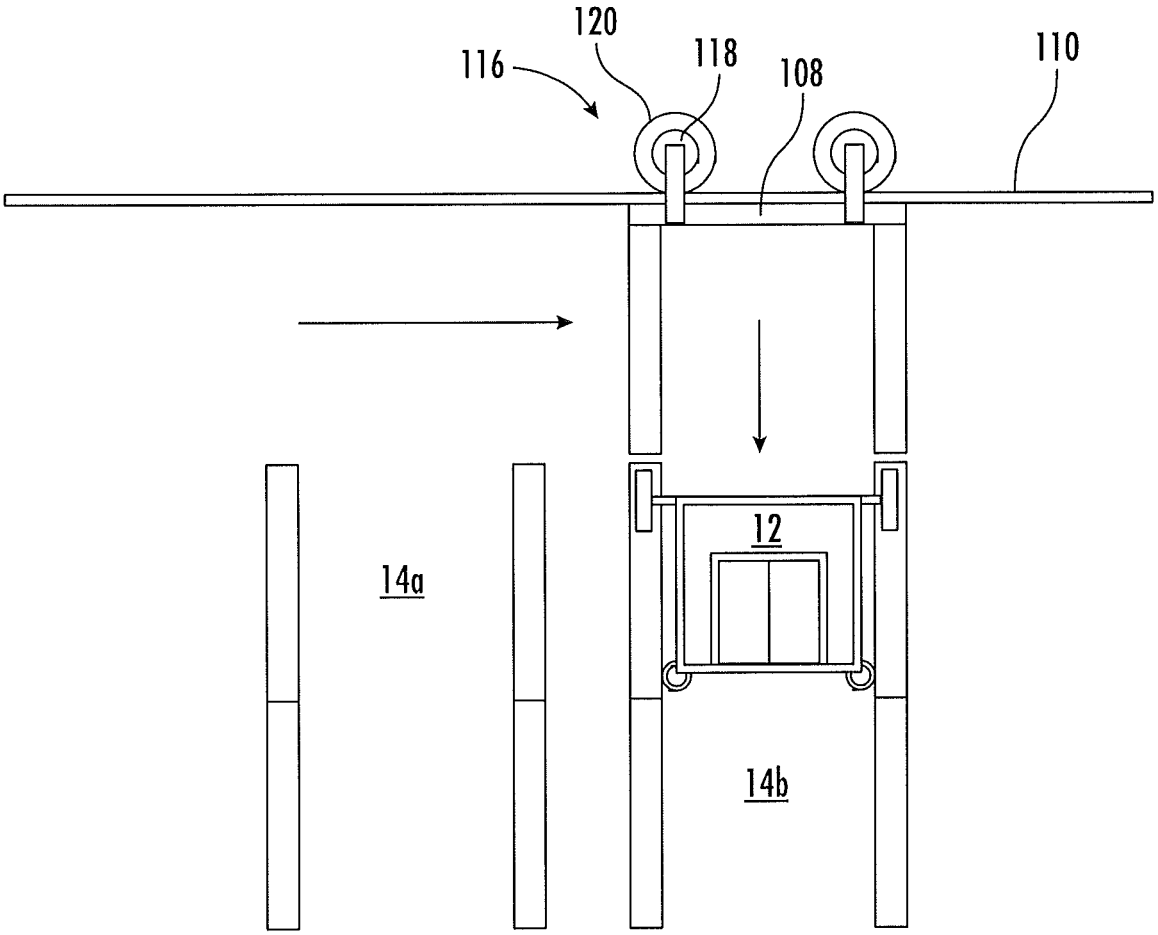
FIG. 11 is another schematic illustration of a transfer of an elevator car between two hoistways.

Referring now to FIGS. 9-11, an elevator car 12 is transferred from hoistway 14*a* to hoistway 14*b* by, for example, driving the elevator car 12 into the upper transfer carriage 108 at the first hoistway 14*a*, as illustrated in FIG. 9. Referring now to FIG. 10, the upper transfer carriage 108 is then driven along the upper transfer rail 110 by a transfer carriage drive 116 from the first hoistway 14*a* to a second hoistway 14*b*. In some embodiments, the upper carriage drive 116 includes a carriage prime mover 118 operably connected to a carriage wheel 120, which is interactive with the upper transfer rail 110. In some embodiments the carriage prime mover 118 is a direct drive prime mover 118, such as a wheel hub motor 44. Referring now to FIG. 11, once the upper transfer carriage 108 arrives at the second hoistway 14*b*, the elevator car 12 may then be driven along the second hoistway 14*b*. One skilled in the art will readily appreciate that the explanation and illustration of the transfer of elevator car 12 from hoistway 14*a* to hoistway 14*b* via the upper transfer carriage 108, is merely exemplary. The structure and process may be similarly utilized to transfer elevator car 12 between any of the hoistways 14*a*, 14*b*, 14*c*, 14*d*, 14*e*, utilizing the upper transfer cage 108, the lower transfer cage 110, and/or any intermediate transfer cage.

Use of the direct drive prime mover 42 and the simply supported elevator car 12 via the drive assembly 18 with the engagement force applied to the rail 16 via the wheels 20 provides a practical configuration for elevator system 10 that may include a recirculating flow of the elevator cars 12. The recirculating flow significantly increases the efficiency of operation of the elevator system 10.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator system comprising:
- a hoistway;
- a rail extending along the hoistway;
- an elevator car disposed in and movable along the hoistway; and
- a drive assembly operably connected to the elevator car and including two or more wheels engaged to opposing surfaces of the rail, the drive assembly configured to apply an engagement force to the rail to both support the elevator car at the rail and drive the elevator car along the rail;
- wherein the two or more wheels engage the rail via an engagement force applied by one or more of a mechanical, electrical or hydraulic actuator;
- wherein the drive assembly includes a hub wheel motor disposed at the wheel including:
  - a stator located at a wheel axis; and
  - a rotor surrounding the stator and drivable about the wheel axis by an electromagnetic field of the stator;
  - wherein a wheel rim is operably connected to the rotor and is surrounded by the rotor.

2. The elevator system of claim 1, wherein a prime mover is operably connected to a wheel of the two or more wheels to drive rotation of the wheel about a wheel axis.

3. The elevator system of claim 1, wherein the rail includes a rail web connected to rail flanges, the wheels disposed on opposing sides of the rail web.

4. The elevator system of claim 3, wherein applying the engagement force urges the wheels toward the rail web.

5. The elevator system of claim 1, further comprising a bearing assembly to support the drive assembly at the elevator car.

6. The elevator system of claim 1, wherein the drive assembly is disposed at a top of the elevator car.

7. The elevator system of claim 1, further comprising two hoistways, wherein the elevator car is configured to transfer from a first hoistway of the two hoistways to a second hoistway of the two hoistways.

8. The elevator system of claim 7, further comprising:
- a first guide rail portion extending along the first hoistway;
- a second guide rail portion extending along the second hoistway; and
- a transition portion connecting the first guide rail portion and the second guide rail portion;

wherein the elevator car and the drive assembly are configured to allow for travel of the elevator car in a vertical position along the first guide rail portion, the second guide rail portion and the transition portion without disengagement of the elevator car from the guide rail.

9. The elevator system of claim 8, further comprising a bearing assembly to support the drive assembly at the elevator car, the bearing assembly configured to allow for rotation of the elevator car relative to the drive assembly when the elevator car is urged along the transition portion to maintain the elevator car in a vertical orientation.

10. The elevator system of claim 7, further comprising:

a transfer rail; and a transfer carriage receptive of the elevator car and movable along the transfer rail to transfer the elevator car from the first hoistway to the second hoistway, the transfer carriage including a direct drive prime mover to move the transfer carriage along the transfer rail.

11. The elevator system of claim 10, wherein the direct drive prime mover is a wheel hub motor.

12. An elevator system comprising:

a first hoistway;

a second hoistway;

a guide rail including:

a first guide rail portion extending along the first hoistway;

a second guide rail portion extending along the second hoistway; and a transition portion connecting the first guide rail portion and the second guide rail portion;

an elevator car disposed in and movable along the guide rail; and a drive assembly operably connected to the elevator car and including two or more wheels engaged to opposing surfaces of the rail, the drive assembly configured to apply an engagement force to the rail to both support the elevator car at the rail and drive the elevator car along the rail;

wherein the elevator car and the drive assembly are configured to allow for travel of the elevator car in a vertical position along the first guide rail portion, and to transfer from the first hoistway to the second hoistway via the transition portion;

wherein the two or more wheels engage the rail via an engagement force applied by one or more of a mechanical, electrical or hydraulic actuator;

wherein the drive assembly includes a hub wheel motor disposed at the wheel including:

a stator located at a wheel axis; and a rotor surrounding the stator and drivable about the wheel axis by an electromagnetic field of the stator;

wherein a wheel rim is operably connected to the rotor and is surrounded by the rotor.

13. The elevator system of claim 12, wherein the elevator car and the drive assembly are configured to allow for travel of the elevator car in a vertical position along the first guide rail portion, the second guide rail portion and the transition portion without disengagement of the elevator car from the guide rail.

14. The elevator system of claim 13, further comprising a bearing assembly to support the drive assembly at the elevator car, the bearing assembly configured to allow for rotation of the elevator car relative to the drive assembly when the elevator car is urged along the transition portion to maintain the elevator car in a vertical orientation.

15. The elevator system of claim 12, further comprising:

a transfer rail disposed at the transition portion; and a transfer carriage receptive of the elevator car and movable along the transfer rail to transfer the elevator car from the first hoistway to the second hoistway, the transfer carriage including a direct drive prime mover to move the transfer carriage along the transfer rail.

16. The elevator system of claim 12, wherein the rail includes a rail web connected to rail flanges, the wheels disposed on opposing sides of the rail web.

* * * * *